United States Patent [19]

Bouwens et al.

[11] Patent Number: 4,783,856

[45] Date of Patent: Nov. 15, 1988

[54] DISPOSABLE RAIN GARMENT

[75] Inventors: Harold J. Bouwens, Newark; David V. Dobreski, Fairport; Clifford H. Patridge, Jr., Newark, all of N.Y.

[73] Assignee: Mobil Oil Corporation, New York, N.Y.

[21] Appl. No.: 145,013

[22] Filed: Jan. 19, 1988

[51] Int. Cl.[4] ..... A41D 3/04

[52] U.S. Cl. ..... 2/87; 2/243 B

[58] Field of Search ..... 2/82, 84, 87, 243 B

[56] References Cited

U.S. PATENT DOCUMENTS

| | | | |
|---|---|---|---|
| 3,111,677 | 11/1963 | Artzt . | |
| 3,665,518 | 5/1972 | Leadford . | |
| 3,710,396 | 1/1973 | Tomlinson . | |
| 3,865,235 | 2/1975 | Levy et al. . | |
| 3,946,443 | 3/1976 | Knight | 2/82 |
| 4,067,067 | 1/1978 | Neuls . | |
| 4,118,802 | 10/1978 | Polster | 2/84 |
| 4,313,229 | 2/1982 | Villahane | 2/87 |
| 4,390,096 | 6/1983 | Goldenberg . | |

*Primary Examiner*—Werner H. Schroeder
*Assistant Examiner*—Jeanette E. Chapman
*Attorney, Agent, or Firm*—Alexander J. McKillop; Michael G. Gilman; Charles J. Speciale

[57] ABSTRACT

Disposable outer rain garments which may be dispensed from a continuous web of a tubular, lay-flat plastic film material. The web of lightweight plastic lay-flat tubular material is imparted with suitable rear lines preferably formed from parallel, transversely perforations spaced at suitable and regular intervals along the length extending of the web so as to define individual garments. As a garment is needed by a wearer, the web is drawn off from a supply or feed roll and torn off at the next perforation from the dispensed end of the web. Adjacent to the perforation defining the top of the garment, but ahead of the perforation, there is formed a sealed edge with a perforated aperture for the through-passage of the head of a wearer. At the opposite edges of the web, in effect, at both sides of the garment, perforated apertures are formed for the through-passage of arms.

5 Claims, 2 Drawing Sheets

DISPOSABLE RAIN GARMENT

BACKGROUND OF THE INVENTION

1. Field of the Invention

The present invention relates to disposable outer rain garments which may be dispensed from a continuous web, and more particularly, to pull-over type disposable rain coats or jackets.

Disposable outergarments, such as foul weather clothing, are well known in the art, as is the practice of dispensing such types of clothing from a continuous sheet or roll constituted of a thermoplastic web material. Clothing of this type includes coats, ponchos, hooded jackets, headwear and pants. The primary advantage of these outergarments resides in that they are easily dispensed and donned by the wearer, they are of a lightweight construction, and are inexpensive so as to render them economically disposable after even a single use if the wearer chooses to discard the garment.

2. Discussion of the Prior Art

In the prior art, several types of such disposable articles are disclosed, particularly disposable rain or foul weather garments which are, however, subject to several disadvantages and, in many instances, inconvenience the wearer.

Goldenberg U.S. Pat. No. 4,390,096 discloses a continuous sheeting which is adapted to be separated along suitable tear lines into individual ponchos. The ponchos have open sides which allow wind and rain to swirl about and under the garment whereby a garment of that kind is not particularly practical in a driving rain or under windy conditions.

Leadford U.S. Pat. No. 3,665,518 relates to disposable rain ponchos formed from a continuous plastic web material, and attempts to deal with the problem encountered in Goldenberg by providing ties at the edges of the material enabling the front end back of the poncho to be tied together. This type of poncho also is not particularly useful when the wind is high in intensity.

Neuls U.S. Pat. No. 4,067,067 describes other types of disposable wrap-around type ponchos formed from continuous webs of thin flexible webs, which also must be provided with ties in order to ameliorate the effects of wind on the usefulness of the poncho, and the construction thereof is subject to the same disadvantages as the prior art garments.

The novel pull-over type of disposable rain garment pursuant to the present invention obviates the problems of strong winds and driving rain which are encountered with the poncho type garment. Although the prior art discloses several versions of disposable rain garments of the pull-over type; each is subject to one or more disadvantages or limitations, one of the most important of which being the unduly high cost of manufacture of such disposable garments. Disposability is, of course, a primary consideration that such articles must be relatively inexpensive to manufacture whereby the cost to the wearer is sufficiently low to render the disposing of the garments economical.

However, in the prior art, the necessary low cost of manufacture of the disposable garments is obviously adversely affected by the need for elaborate and expensive form-shaping techniques and the resulting styles. Thus, Polster U.S. Pat. No. 4,118,802 disclosed disposable garment formed from a continuous web of a flexible material, which are provided with arm sleeves and a hood for the wearer's head. A similar article of disposable wear is described in Knight U.S. Pat. No. 3,946,443. An additional disadvantages resulting from this construction of the disposable garment is that, in order for the garment to be able to be pulled over the wearer's head and torso such that the wearer's arms may fit into the sleeves, the material must be stronger and tear-resistant in nature so as to be functional. This will lead to increased costs in manufacture, as well as to an increased cost to the ultimate user. Furthermore, the presence of sleeves and hoods on the garments, while being practical and aesthetically attractive, will necessitate the manufacture of garments of various sizes so as to resultingly, increase costs of manufacture. This may also increase prices for the retail consumer, and may in all likelihood negate the advantageous aspects of disposibility of the garments.

A further disadvantage of prior art pull-over type disposable rain garments is the lack of comfort which is usually afforded to the wearer, inasmuch as the garments described herein above must be sized in order to properly fit with some degree of comfort to the wearer. In this connection, Villafene U.S. Pat. No. 4,313,229 discloses a garment incorporating an operable T-shaped perforation for inserting the garment over the head of the wearer, and also provides slits in the front of the garment which permit the wearer to extend his hands or arms out of the garment. However, this T-shaped perforation, when torn open to allow for wearing of the garment, exposes the neck and chest of the wearer to the inclement weather, and if the wearer is of small stature, may also expose a considerable portion of the body of the wearer to the elements.

SUMMARY OF THE INVENTION

The present invention eliminates or substantially ameliorates the disadvantages encountered in the prior art through the provision of an inexpensive, disposable, pullover rain garment formed from a continuous web of a thermoplastic film -material, and which fits most common sizes. The wearer of the garment is afforded maximum comfort, and the durability and integrity of the garment is exceptional in nature, notwithstanding the fact that the garment is of lightweight construction and disposable material which is extremely inexpensive.

A continuous web of a lightweight plastic lay-flat tubing is imparted with suitable tear lines preferably formed from parallel, transversely perforations spaced at suitable and regular intervals along the length extending of the web so as to define individual garments. As a garment is needed by a wearer, the web is drawn off from a supply or feed roll and torn off at the next perforation from the dispensed end of the web. Adjacent to the perforation defining the top of the garment, but ahead of the perforation, there is formed a sealed edge with a perforated aperture for the through-passage of the head of a wearer. At the opposite edges of the web, in effect, at both sides of the garment, perforated apertures are formed for the through-passage of arms. Inasmuch as such arm holes are located proximate the transverse seal forming the top sealed edge of the garment, which is supported on the shoulders of the wearer, the arm holes allow the garment to be worn by wearers of practically any commonly normal size. The holes for the arms and head are preferably circular in shape so as to prevent any undue stretching and/or tearing of the garment as the wearer dons the garment. The disposable garment pursuant to the present invention is inexpensive to manufacture since the plastic film material is lightweight in nature and its construction is simple, the intended garment being provided with only a head hole and two arm holes, and therefore, the cost to the consumer is low.

Accordingly, it is an object of the present invention to provide a disposable rain garment which is inexpensive and lightweight, yet durable due to the formation of the apertures therein for the through-passage of the head and arms of a wearer.

It is a further object of the invention to provide a disposable rain garment of the type described which fits substantially all sizes and is easily donned, as well as being comfortable during wear thereof.

Yet another further object of the invention is to provide a disposable rain garment which is dispensed from a continuous roll or web of a lay-flat tubular plastic film material.

A still further object of the invention is to provide a disposable rain garment of the type described in which the apertures for the arms and head of the wearer are circularly shaped in order to impart comfort to the wearer during wearing of the garment, as well as to prevent stretching or tearing of the garment while it is being donned by the wearer.

BRIEF DESCRIPTION OF THE DRAWINGS

The foregoing objects and other features of the invention will become more readily apparent and may be understood by referring to the following detailed description of an illustrative embodiment of the disposable rain garment, taken in conjunction with the accompanying drawings; in which.

DETAILED DESCRIPTION OF THE PREFERRED EMBODIMENTS

Figure 1:
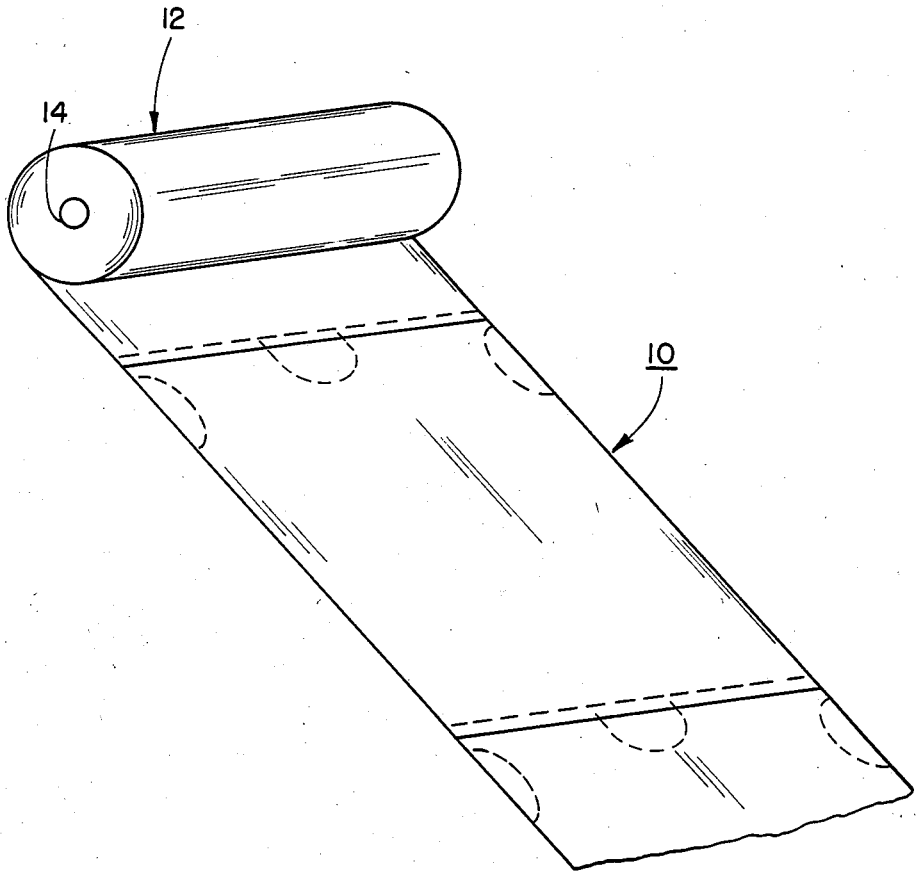
FIG. 1 illustrates a perspective view of a continuous web of a pliant lay-flat tube of plastic film material dispensed from a roll for sequential removal of the disposable rain garments pursuant to the present invention.

Referring now in specific detail to the drawings, in which identical reference numerals identify similar or identical elements throughout the several views, FIG. 1 shows a sequence of disposable rain garments 10 as they are being dispensed from continuous rolled-up web 12. The rolled-up web extends 12 about a hollow core 14 which is adapted to be slipped over a suitable support rod or pole (not shown) for ready dispensing. The web 12 is constituted from a lightweight waterproof material, preferably a plastic lay-flat tubular film material such as, but not limited to, polyethylene or polypropylene. The plastic material may be transparent or opaque, and if desired, may have decorative patterns or indicia imprinted thereon so as to enhance the aesthetic appearance and sales appeal of the disposable rain garments.

Figure 2:
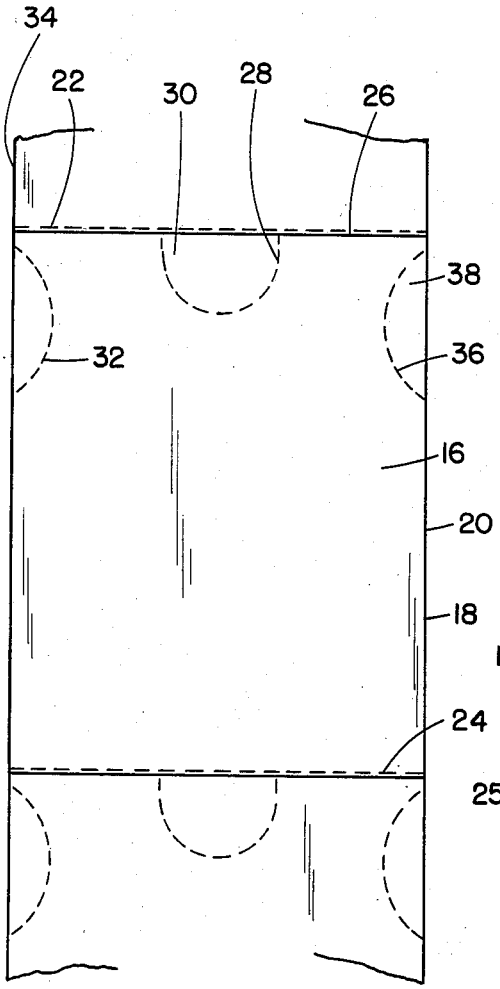
FIG. 2 illustrates a front view of the disposable rain garment of the present invention.

The body portion 16 of each disposable rain garment is preferably without any side seams due to the lay-flat tubular film web construction, and as seen in FIG. 2, the web is flat with the longitudinal side edges 18 and 20 thereof defining the sides of the body portion 16, resulting in the rectangular shape of the garment as it is dispensed and detached from the web 12. Transversely extending perforations 22 and 24 which extend in parallel spaced relationship to each other and perpendicular to the side edges 18 and 20, respectively, define the top and bottom; in essence, the length of the disposable rain garment.

A transverse seal 26 extending adjacent to and parallel with the top perforation 22, on the side thereof towards the bottom perforations 24 of the particular garments seals the tubing and renders the garment open-ended only at the bottom thereof. The semi-circular perforation 28 defines the aperture 30 for the through-passage of the head of a wearer, and semi-circular perforations 32 and 36 on the opposite sides of the body portion 16, respectively, define the arm-receiving aperture 30 is located centrally intermediate the side edges 18 and 20, and bisects the sealed edge 26 about the longitudinal axis of body 16 of the garment. Arm apertures 34 and 38 are located slightly below the sealed edge 26 whereby, when the sealed edge 26 rests on the shoulders of a wearer, the arms of the wearer will comfortably extend through the apertures 34 and 38 without causing any bunching or stretching of the garment at the shoulders or at the underarms.

During manufacture, the formation of the sealed edge 26 is generally effected through a heat seal; however, it may be formed from any other type of seal which adheres the two plys of the lay-flat tubing. The perforations 22, 24, 28, 32 and 36 extend through both layers of the tubing, with perforations 28, 32 and 36 preferably being generally semi-circular in configuration with the perforations 32 and 36 extending to the respective side edges 18 and 20. The perforation 28 extends through the sealed edge 26, preferably up to the perforation 22.

When it is desired to employ a garment 10, a garment body 16 is dispensed from the free end of the web 12 by being detached from the subsequent garment body through tearing along the top transverse perforation 22, the bottom perforation having been previously torn open upon the tearing off of the preceding garment body. After separation from the web 12, the wearer tears along the perforation 28 to open the head aperture 30, and then tears along the perforations 32 and 36 so as to open the respective arm apertures 34 and 38. The wearer then dons the garment 10 by slipping the garment body 16 over his head and upper torso, extending his arms through the arm apertures 34 and 38, and his head through the head aperture 30. The sealed edge 26 along the top of the garment body portion 16 then rests comfortably on the shoulders of the wearer, without any appreciable bunching or stretching of the material due to the location of the arm apertures which are located in close proximity to the shoulder joints of the wearer.

The semi-circular perforation 28 for the head aperture 30 produces a substantially circular head aperture 30. This avoids bunching and stretching at the neck, while providing a rounded, comfortably fitting collar for the wearer. The foregoing also applied to the circular arm apertures 24 and 38.

Figure 3:
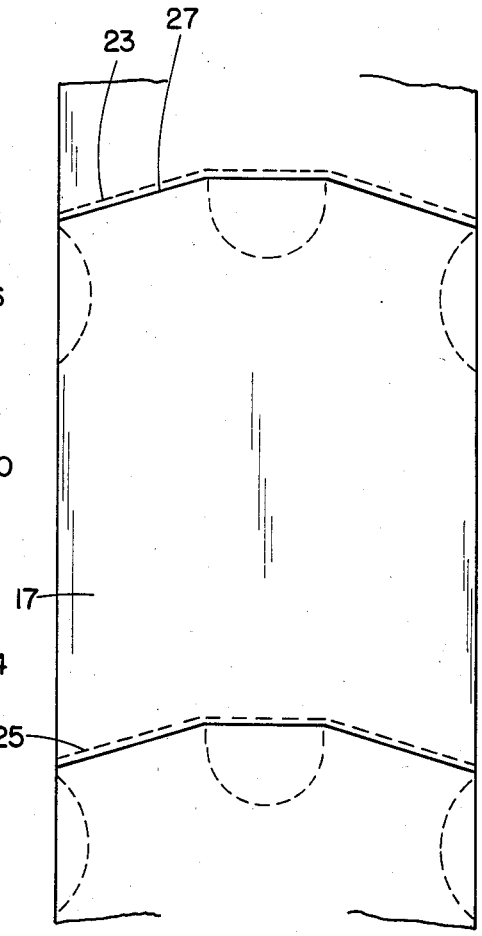
FIG. 3 illustrates a front view of a second embodiment of the disposable rain garment.

FIG. 3 illustrates an alternate embodiment of the disposable rain garment, wherein the sealed edge 27 and perforations 23 and 25 are angled upwardly towards the head aperture 30 from the opposite sides of body portion 17. This allows the upper end of the garment body portion 17 to follow the more natural curve of a wearer's shoulders. The head aperture 30 and arm apertures 34 and 38 are similar in configuration and location with those shown in FIGS. 1 and 2.

Although the lines of separation for detaching the garment from the remaining continuous film web have been referred to herein as perforations, this terminology is deemed to also incorporate discontinuous slits, or weakening tearlines and the like for separating the various film web components so as to form the finished wearable disposable rain garment.

The disposable rain garment pursuant to the present invention is of a lightweight, yet durable construction, due to the novel configuration of its arm and head apertures, which are generally the areas subjected to the most intense stresses and are prone to tearing. Since the garment is primarily designed as a temporary measure of protection against the forces of the elements, the rain garment is constructed as inexpensively as possible, with primary consideration being given to the comfort of the wearer.

While the invention has been particularly shown and described with reference to the preferred embodiments, it will be understood by those skilled in the art that various changes in form and detail may be made therein without departing from the spirit and scope of the invention. Accordingly, modifications and/or additions such as sleeves or hoods may be provided as desired, and are considered to be within the scope of the invention.

What is claimed is:

1. A disposable rain garment which is separable from a continuous web of a lay-flat tubular waterproof film material forming at least two plys; first and second parallel transverse perforations spaced from each other across said web so as to define the length of said garment therebetween; a transverse seal joining the plys of said film material extending adjacent to and in parallel with said first transverse perforations on the side thereof towards the second transverse perforations; a curvilinear perforation extending through said web at the longitudinal central axis of said tubular body and intersecting said first transverse perforation and said transverse seal to define an aperture for the head of a wearer; and curvilinear perforations extending through said web in proximity to said transverse seal and diametrically opposite each other at the edges of said lay-flat tubular film material to define apertures for the arms of a wearer.

2. A disposable rain garment as claimed in claim 1, wherein said garment has a substantially rectangular lay-flat configuration, said perforations for the arm apertures being semi-circularly shaped and extending through said tubular lay-flat film material so as to form a substantially circular cutout for each arm of the wearer upon detaching the semi-circular web portions.

3. A disposable rain garment as claimed in claim 1, wherein said perforations for the head aperture perforation are of a semi-circular shape extending through said lay-flat film material so as to form a substantially circular cutout for the head of the wearer upon detaching said semi-circular web portion.

4. A disposable rain garment as claimed in claim 3, wherein said seal is separated into two sections upon detaching said semi-circular web portion for forming the head aperture, each section having one end terminating at said head aperture and extending at a downward sloping angle towards the side edges of said lay-flat film material.

5. A disposable rain garment as claimed in claim 1, wherein said film web is constituted of a lightweight thermoplastic material.

* * * * *